US007906034B2

(12) United States Patent
Posson et al.

(10) Patent No.: US 7,906,034 B2
(45) **Date of Patent: *Mar. 15, 2011**

(54) FLAME SUPPRESSANT AEROSOL GENERANT

(75) Inventors: Philip L. Posson, Cave Creek, AZ (US); Mark L. Clark, Glendale, AZ (US)

(73) Assignee: Goodrich Corporation, Charlotte, NC (US)

( * ) Notice: Subject to any disclaimer, the term of this patent is extended or adjusted under 35 U.S.C. 154(b) by 627 days.

This patent is subject to a terminal disclaimer.

(21) Appl. No.: 11/905,418

(22) Filed: Oct. 1, 2007

(65) Prior Publication Data

US 2008/0245537 A1 Oct. 9, 2008

Related U.S. Application Data

(63) Continuation of application No. 10/835,568, filed on Apr. 30, 2004, now Pat. No. 7,407,598.

(51) Int. Cl.

| | |
|---|---|
| ***A62D 1/06*** | (2006.01) |
| ***A62C 3/00*** | (2006.01) |
| ***C06B 29/02*** | (2006.01) |
| ***C06B 29/14*** | (2006.01) |
| ***C06B 29/16*** | (2006.01) |

(52) U.S. Cl. ..... 252/5; 252/2; 252/610; 169/45; 169/46; 169/64; 149/17; 149/77; 149/83; 149/109.2; 149/115

(58) Field of Classification Search ..... 252/5, 2
See application file for complete search history.

(56) References Cited

U.S. PATENT DOCUMENTS

| | | | | |
|---|---|---|---|---|
| 2,995,526 | A * | 8/1961 | De Ment | 149/74 |
| 3,234,059 | A * | 2/1966 | Proell | 149/19.7 |
| 3,690,971 | A * | 9/1972 | Gunderloy et al. | 149/19.6 |
| 3,910,805 | A * | 10/1975 | Catanzarite | 149/83 |
| 4,078,954 | A * | 3/1978 | Bernardy | 149/19.8 |
| 4,203,786 | A * | 5/1980 | Garner | 149/19.91 |
| 5,861,106 | A * | 1/1999 | Olander | 252/7 |
| 5,865,257 | A * | 2/1999 | Kozyrev et al. | 169/46 |
| 5,898,126 | A * | 4/1999 | Yoshida | 149/46 |
| 6,004,411 | A * | 12/1999 | Zeuner et al. | 149/78 |
| 6,024,889 | A * | 2/2000 | Holland et al. | 252/5 |
| 6,076,468 | A * | 6/2000 | DiGiacomo et al. | 102/530 |
| 6,132,537 | A * | 10/2000 | Zeuner et al. | 149/45 |
| 6,427,599 | B1 * | 8/2002 | Posson et al. | 102/336 |
| 2005/0263224 | A1 * | 12/2005 | Wu et al. | 149/46 |
| 2007/0163787 | A1 * | 7/2007 | Posson et al. | 169/85 |

* cited by examiner

*Primary Examiner* — Joseph D Anthony
(74) *Attorney, Agent, or Firm* — Murphy & King, P.C.

(57) ABSTRACT

The present invention is directed to pyrotechnic aerosol fire suppression compositions that burn rapidly, but coolly. The rapid burning of the compositions of the present invention produces a voluminous flame-suppressive aerosol that is useful in suppressing and/or extinguishing both small and large fires. The compositions of the invention contain at least one oxidizer and a fuel component comprising at least one organic acid salt, which combination produces a rapid burning composition that burns at low temperatures with little or no flame and have a low heat of combustion.

12 Claims, No Drawings

FLAME SUPPRESSANT AEROSOL GENERANT

CROSS-REFERENCE TO RELATED APPLICATIONS

This application is a continuation of U.S. patent application Ser. No. 10/835,568, filed Apr. 30, 2004, now U.S. Pat. No. 7,407,598, the entire disclosure of which is incorporated by reference herein.

FIELD OF THE INVENTION

The present invention relates to improved flame-suppressive aerosol generants, in particular, compositions including mixtures of potassium salt oxidizers and potassium salts of organic acids.

BACKGROUND OF THE INVENTION

Flame suppressants are classified as either active (chemical) or passive (physical) suppressants. Active suppression agents react chemically with and destroy free radicals in the flame. Free radicals are very short-lived species that catalyze flame reactions. Their removal by the action of potassium salts, particularly halides, may be used to extinguish flames and even to reduce the secondary muzzle flash of guns.

One form of active suppressant is a class of materials called Halon™, which are composed of brominated or chlorinated fluorocarbon compounds, e.g., bromochlorodifluoromethane ($CF_2BrCl$) and trifluorobromomethane ($CF_3Br$). Halon™ materials have been used effectively as fire suppression agents for years, typically to protect electrical equipment since there is very little residue to clean up. Halon™ fire suppression agents typically interrupt the chemical reaction that takes place when fuels burn and depend on a combination of chemical effectiveness, e.g., quenching of free radicals, and some physical effectiveness, e.g., cooling the combustion flame and dilution of the combustion ingredients. Certain halogen-containing fire suppression agents, however, such as $CF_3Br$, contribute to the destruction of stratospheric ozone. Although Halon™ materials are essentially nontoxic, passage through a flame or over hot surfaces produces some very toxic fluorine compounds.

To reduce the environmental effects associated with Halons™, most commercially available fire suppression agents designed today are passive, i.e., physically acting, agents. A passive suppressant does not react chemically with the flame. These fire suppression agents either blanket the burning material to deprive it of oxygen, or they dilute the oxygen in the environment to below the point that can sustain the flame, or they cool the burning surface below its ignition temperature.

Examples of physically-acting fire suppression agents include sodium bicarbonate and sand as well as inert gases, e.g., carbon dioxide ($CO_2$), water vapor ($H_2O$), and nitrogen ($N_2$). When applied to a fire, inert gases physically displace oxygen from the combustion region while simultaneously serving as a heat sink to reduce the temperature of the flame. The combination of the two physical actions results in suppression of the fire. Gaseous passive agents cannot be used as total flooding agents in occupied spaces because they must reduce the oxygen content below the amount that will sustain life. This is especially true for carbon dioxide because it also interferes with human respiration at high concentrations.

Unfortunately, physically-acting fire suppression agents tend to be less efficient than chemically-acting fire suppression agents. Accordingly, a larger quantity of a physically-acting fire suppressant is required in order to suppress a fire and, consequently, equipment and storage must be large to accommodate the large quantity. Such large equipment is a disadvantage in limited spaces. Applications in which space and weight are limited include military or civilian aircraft or ground vehicle engine bays, automobiles, spacecraft, or military or civilian aircraft drybays. Another disadvantage of dry physical suppressants is their particle size, which requires physical blowing or shoveling to emplace them. The large size of the particles also prevents penetration of the agent to combustion areas which are concealed or relatively inaccessible.

As a result, relatively small areas are typically equipped with handheld fire extinguishers that require a person to operate. Because aircraft cargo bays and cargo containers on ships and trains are generally left unmonitored, a fire in these areas can become serious before anyone becomes aware that the fire even exists. The spread of fire from these relatively small areas can result in the loss of the entire vehicle. Thus, current fire suppression methods in such areas depend on human intervention, providing that such intervention occurs promptly enough to prevent the fire from spreading and causing large scale damage.

An advantageous alternative to the above suppressant agent systems is the use of a pyrotechnically-generated aerosol flame free radical suppressant. This generation method may provide such fine particles that their free-fall velocity is less than the velocity of air currents in an enclosed space. As such, the particles stay suspended in the exhaust of the pyrochemical generator, and seek out even concealed fires such as those that might be found inside aircraft cargo subcontainers, such as the LD-3 container used on commercial aircraft. The smoke-like suspension characteristics of the aerosol provide long "hang times," referring to the length of time a single generator function can continue to suppress recurrent flame. Another advantage of such pyrochemically generated aerosol is that their ozone-depleting potential may approach zero, that their inhalation toxicity may be much lower than that of inert gas, and that no toxic irritant gases may be generated on passage through flame or with hot surfaces.

The use of currently known pyrotechnic flame suppressant aerosol generating compositions as can be problematic. For example, such aerosol generating compositions have some thermal stability problems and are significantly sensitive to accidental ignition by mechanical impact or friction. This sensitivity poses a safety concern in their manufacture, storage and use.

Prior art aerosol generating flame suppressants typically produce unduly hot and destructive gases. Such gases may include permanent gases and suppressant vapor prior to its condensation to an aerosol, the form in which the flame suppressant is delivered. If these gases are not cooled, structures, machinery, cargo and living beings may be damaged. In fires in an enclosed space, hot gases rapidly rise and can carry an aerosol flame suppressant up above a low-lying fire, where it cannot extinguish the fire.

The use of solid coolants, however, condenses and traps at least a portion of the aerosol generating flame suppressant, rendering it ineffective in putting out the flames. As a result, it is necessary to use a larger amount of aerosol generating flame suppressant, which detrimentally produces additional heat and destructive gas. Moreover, solid coolants are heavy and voluminous, often being two or six times the weight and volume of the aerosol generating flame suppressant. In addition, the coolants often produce toxic gases, such as carbon monoxide, to the peril of nearby persons.

As such, there is a need in the art for clean, effective, non-toxic, non-ozone depleting, and inexpensive fire extinguishing agents.

SUMMARY OF THE INVENTION

The present invention relates to a pyrotechnic aerosol fire suppression composition comprising an oxidizer represented by the formula $M(XO_x)_y$, wherein M is selected from a Group IA atom, a Group IIA atom, a Group IIIA atom, X is selected from the group consisting of F, Cl, Br and I, x is 1-4, and y is 1-3; and a fuel component comprising melamine cyanurate, a Group IA or Group IIA salt of an organic acid, or a mixture thereof, wherein the organic acid is selected from the group consisting of cyanuric acid, isocyanuric acid, barbituric acid, hydroxyacetic acid,

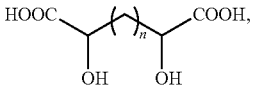

wherein n is 0 to 4 and a mixture thereof; and the oxidizer is present in a greater amount by weight percent than the fuel component.

In a preferred embodiment, M of the oxidizer $M(XO_x)_y$ is selected from the group consisting of potassium and sodium. In another preferred embodiment, $XO_x$ of the oxidizer $M(XO_x)_y$ is selected from the group consisting of a chlorate, a bromate, an iodate, a perchlorate, and a chlorite. In a more preferred embodiment, $XO_x$ is a bromate. Accordingly, $M(XO_x)_y$ preferably is selected from the group consisting of sodium bromate, potassium bromate, and mixtures thereof. In one embodiment, the oxidizer is present in an amount of about 70 percent or less by weight of the total composition.

In a preferred embodiment, the fuel component is melamine cyanurate or a Group IA or Group IIA salt of cyanuric acid, isocyanuric acid, barbituric acid, hydroxyacetic acid, or tartaric acid. In another preferred embodiment, the fuel component is selected from the group consisting of potassium cyanurate, potassium tartrate, magnesium cyanurate, magnesium tartrate, and mixtures thereof. The fuel component is present in an amount of about 40 percent or less by weight of the total composition.

In one embodiment, the weight ratio of oxidizer to fuel component is from about 3:2 to about 4:1. In yet another embodiment, the compositions of the present invention may further comprise a binder selected from the group consisting of a silicate, a cellulose derivative, a cellulose ether, an alginic binder, a gum, a gel, a pectin, a starch, a polyvinyl compound, and a mixture thereof, and optionally a polyol selected from the group consisting of a glycerol or a glycol.

The present invention also relates to a method of suppressing a flame comprising the steps of providing a pyrotechnic aerosol fire suppressant composition by combining an oxidizer represented by the formula $M(XO_x)_y$, wherein M is selected from a Group IA atom, a Group IIA atom, and a Group IIIA atom, X is selected from the group consisting of F, Cl, Br and I, x is 1-4, and y is 1-3; and a fuel component comprising melamine cyanurate, a Group IA or Group IIA salt of an organic acid, or a mixture thereof, wherein the organic acid is selected from the group consisting of cyanuric acid, isocyanuric acid, hydroxyacetic acid and

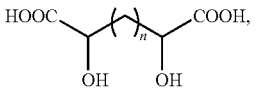

wherein n is 0 to 4 and the oxidizer is present in a greater amount by weight percent than the fuel component; igniting the pyrotechnic aerosol fire suppressant composition and generating an aerosol comprising a plurality of combustion products, wherein the aerosol has a velocity; and applying the aerosol to a flame in an amount sufficient to suppress the flame.

In a preferred embodiment, the oxidizer is selected from the group consisting of sodium bromate, potassium bromate, and mixtures thereof and the fuel component is selected from the group consisting of melamine cyanurate, potassium cyanurate, potassium isocyanurate, potassium barbiturate, potassium hydroxyacetate, potassium tartrate, magnesium cyanurate, magnesium isocyanurate, magnesium barbiturate, magnesium hydroxyacetate, magnesium tartrate, and mixtures thereof. In each case, there is sufficient metal ion associated with the acidic fuel moiety to raise the pH of the acid fuel above 6.5, preferably above 7.0, but less than pH 11 in water solution. In another embodiment, the pyrotechnic aerosol fire suppressant composition burns to form combustion products that are selected from the group consisting of $H_2O$, $CO_2$, nitrogen, a halide salt, a carbonate salt, and mixtures thereof. In one embodiment, the heat of combustion of the pyrotechnic aerosol fire suppression composition is between about 250 calories per gram to about 600 calories per gram.

In a preferred embodiment, the method utilizes a weight ratio of the oxidizer to the fuel component of from about 3:2 to about 4:1. In yet another embodiment, the pyrotechnic aerosol fire suppressant composition has a burn rate of about 5 to about 60 seconds per inch.

In a preferred embodiment, the pyrotechnic aerosol fire suppressant composition further comprises a binder. In another embodiment, the method utilizes a pyrotechnic aerosol fire suppressant composition that is pressed into at least one shaped solid unit, wherein at least one shaped solid unit is a cylinder, a slab, a block or a cone. Preferably, at least one shaped solid unit is arranged within a vessel or casing having at least one opening or vent and an ignition assembly. In another embodiment, at least one portion of the ignition assembly initiates the ignition of the at least one shaped solid unit.

The present invention also relates to a method of suppressing a flame comprising the steps of providing a pyrotechnic aerosol fire suppressant composition by combining an oxidizer selected from the group consisting of sodium bromate, potassium bromate, and mixtures thereof, and a fuel component selected from the group consisting of potassium cyanurate, potassium isocyanurate, potassium barbiturate, potassium hydroxyacetate, potassium tartrate, magnesium cyanurate, magnesium isocyanurate, magnesium barbiturate, magnesium hydroxyacetate, magnesium tartrate, and mixtures thereof, wherein the weight ratio of the oxidizer to the fuel component is from about 3:2 to about 4:1; igniting the pyrotechnic aerosol fire suppressant composition and generating an aerosol comprising a plurality of combustion products, wherein the aerosol has a velocity; and applying the aerosol to a flame in an amount sufficient to suppress the flame.

In a preferred embodiment, the pyrotechnic aerosol fire suppressant composition has a burn rate of about 5 to about 60 seconds per inch.

DETAILED DESCRIPTION OF THE INVENTION

The present invention is directed to pyrotechnic aerosol fire suppression compositions that burn rapidly, but at a relatively low temperature. The rapid burning of the compositions of the present invention produces a voluminous flame-suppressive aerosol that is useful in suppressing and/or extinguishing both small and large fires. These compositions are particularly useful in confined spaces, such as a room, engine compartments, dry-bay spaces in aircraft and other vessels, electronic volumes prone to fire, or any other enclosed space. The compositions of the invention contain at least one oxidizer and a fuel component comprising at least one organic acid salt, which combination produces a rapid burning composition that burns at low temperatures with little or no flame. As used herein, the terms "fire" and "flame" are used herein to include all oxidative, burning, and other combustion processes.

Compositions

The compositions of the present invention preferably burn rapidly at low pressures, produce nontoxic products, are stable to accidental ignition by mechanical impact or friction, do not quickly smoke-pillar upward, are odorless, and combust without appreciable flame. Typically, the compositions of the present invention comprise materials having a low heat of combustion and burn cleanly to minimize toxic and destructive byproducts. To accomplish these burn characteristics, the pyrotechnic aerosol fire suppression compositions comprise at least one inorganic halogen or nitrate component or a mixture thereof as the oxidizer and at least one organic salt as a fuel component, wherein the at least one inorganic halogen or nitrate oxidizer or mixture thereof is present in a greater amount by weight percent than the at least one organic salt. As used herein, the term "inorganic halogen" includes inorganic halates, inorganic perhalates, and inorganic halites. In other embodiments where the oxidizer is a mixture of an inorganic halogen and an inorganic nitrate, the inorganic nitrate component is typically from about 1 to about 50% of the halogen content. by weight, to reducing the burning rate, cost or sensitivity of the composition.

The oxidizers used in the compositions of the present invention typically are strong oxidizers, including, but are not limited to, Group IA, Group IIA, Group IIIA, salts of nitrates, $XO_3$, i.e., halates, $XO_4$, i.e., perhalates, $XO_2$, i.e., halites, or wherein X is selected from the group consisting of F, Cl, Br and I. Thus in one embodiment, the oxidizers are represented by the formula $M(XO_x)_y$, wherein M is selected from a Group IA atom, a Group IIA atom, a Group IIIA atom, x is 1-4, and y is 1-3. A suppressive halide salt, such as a Group IA, Group IIA or a Group IIIA halide salt, may be added to the composition, which salt can vaporize and recondense in the cooler regions of the reaction, thus increasing the suppressive power of the aerosol and decreasing the composition burning temperature and rate. Typically, the suppressive halide salt is present between about 0.1 to about 20 weight percent, preferably between about 1 to about 15 weight percent. In another embodiment, the suppressive halide salt is present between about 3 to about 10 weight percent. Compositions containing ammonium or alkylamine salts are less desirable, as they may unduly increase the handling sensitivity of the composition.

$XO_x$ is preferably a perhalate, wherein x is 4; a halite, wherein x is 3; a halite or perhalate, wherein x is 2. Particularly preferred $XO_x$ include chlorates, bromates, iodates, perchlorates, periodates, chlorites, or mixtures thereof. Most preferred $XO_x$ are bromates.

In one embodiment, M is a Group IA atom selected from the group consisting of lithium, sodium, and potassium. In another embodiment, M is a Group IIA atom selected from the group consisting of strontium and magnesium. In yet another embodiment, M is a Group IIIA, particularly aluminum. Preferred M is selected from the group consisting of sodium and potassium. Potassium species are particularly useful as chemically-acting fire suppressive agents because they have been shown to possess significant levels of fire suppressive activity. Thus, in a most preferred embodiment, M is potassium.

Accordingly, examples of oxidizers used in the compositions of the present invention include lithium nitrate, sodium nitrate, potassium nitrate, aluminum nitrate, lithium chlorate, sodium chlorate, potassium chlorate, lithium bromate, sodium bromate, potassium bromate, lithium iodate, sodium iodate, potassium iodate, aluminum iodate, lithium perchlorate, sodium perchlorate, potassium perchlorate, aluminum perchlorate, lithium periodate, sodium periodate, potassium periodate, aluminum periodate, lithium chlorite, sodium chlorite, potassium chlorite, aluminum chlorite, lithium bromite, sodium bromite, or mixtures thereof. Particularly preferred oxidizers used in the compositions of the present invention include sodium bromate, potassium bromate, potassium nitrate, sodium nitrate, or mixtures thereof. More preferably, the oxidizers include potassium bromate or sodium bromate. Mixtures of these oxidizers can be used to control the rate of burning. For example, potassium nitrate or sodium nitrate may be substituted for a portion of potassium bromate to decrease the rate of burning, as well as cost.

In one embodiment, the oxidizer is present in the composition in an amount of about 70 percent or less by weight of the total composition. In another embodiment, the oxidizer is present in an amount of about 60 percent or less by weight of the total composition. In other embodiments, the oxidizer is present in an amount of about 50 percent or less by weight of the total composition, 40 percent or less by weight of the total composition, and even 35 percent or less by weight of the total composition.

In one embodiment, the composition of the invention comprises potassium bromate or sodium bromate as the principal oxidizer. In another embodiment, the potassium bromate or sodium bromate may be combined with a slower combustion agent, e.g., potassium iodate, ammonium iodate, potassium nitrate, to optimize the combustion rate. In yet another embodiment, the addition of a carbonate salt, such as magnesium carbonate, slows the burning reaction down, while at the same time, providing more carbon dioxide gas. The production of carbon dioxide gas displaces any volume of oxygen, which prevents any flame or fire from continuing to burn. The additional slower combustion agent can be added in amounts of up to 25 weight percent of the total oxidant. Measurement of the combustion rate and its optimization each are readily understood by those of ordinary skill in the art.

The fuel component includes, but is not limited to, melamine cyanurate, organic salts of cyanuric acid, isocyanuric acid, barbituric acid, hydroxyacetic acid, and mixtures thereof. The fuel component may also be a salt of other organic acids, including salts of hydroxy alkanedioic acids of the formula:

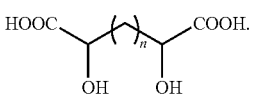

wherein n is 0 to 4, such as, for example, tartaric acid.

The organic salts in the fuel component are preferably Group IA or Group IIA salts. Thus, preferred examples of organic salts use in the compositions of the present invention include, but are not limited to, lithium cyanurate, sodium cyanurate, potassium cyanurate, magnesium cyanurate, lithium isocyanurate, sodium cyanurate, potassium cyanurate, magnesium cyanurate, lithium barbiturate, sodium barbiturate, potassium barbiturate, magnesium barbiturate, lithium hydroxyacetate, sodium hydroxyacetate, potassium hydroxyacetate, magnesium hydroxyacetate, lithium tartrate, sodium tartrate, potassium tartrate, magnesium tartrate, or mixtures thereof. Particularly preferred organic salts in the fuel component are potassium cyanurate, magnesium cyanurate, potassium tartrate, magnesium tartrate, or mixtures thereof.

In one embodiment, the organic salt is present in the composition in an amount of about 50 percent or less by weight of the total composition. In another embodiment, the organic salt is present in an amount of about 40 percent or less by weight of the total composition. In yet another embodiment, the organic salt is present in an amount of about 25 percent or less by weight of the total composition.

Compositions comprising a 1:1 weight ratio of oxidizer to fuel component, such as, for example, potassium bromate and magnesium tartrate, burn rapidly, but produce considerable residue. It has been discovered that compositions comprising a higher weight amount of oxidizer compared to the organic salt component burn rapidly and cleaner, with a lower amount of inorganic residue. In the compositions of the present invention, the oxidizer is present in a greater amount than organic salt. Accordingly, the weight ratio of oxidizer to organic salt is typically from greater than about 1:1, allowing for a cleaner burning composition. In one embodiment, the weight ratio of oxidizer to organic salt is from about 3:2 to about 4:1. In another embodiment, the weight ratio of oxidizer to organic salt is from about 11:9 to about 3:1. In a preferred embodiment, the weight ratio of oxidizer to organic salt is about 3:2 ratio. It has been surprisingly found that higher amounts of oxidizer to organic salt, particularly when the oxidizer to organic salt ratio is about 3:2, the mixture burns faster and cleaner. All upper and lower limits of the ranges described herein can be interchanged to form new limits. Thus, the present invention also encompasses weight ratios of oxidizer to organic salt of from about 11:9 to about 3:1, from about 11:9 to 3:2, and even from about 4:1 to about 3:1.

In one embodiment, less than about 15 weight % of the oxidizer/organic acid remains as residue after combustion. In another embodiment, less than about 10 weight % of the oxidizer/organic acid remains as residue after combustion.

The pyrotechnic aerosol fire suppression compositions of the present invention produce combustion products that are essentially nontoxic and at such a low temperature that extensive cooling is not necessary, particularly advantageous for use in confined spaces. The reaction products may contain $H_2O$, $CO_2$, nitrogen, and a halogen-containing byproduct of the group, such as bromide and carbonate salt, e.g., KBR, $K_2CO_3$, $MgBr_2$ or $MgCO_3$. The type of halogen found in the halogen-containing byproduct depends upon the inorganic halogen-containing component present in the flame suppression composition. The compositions of the present invention avoid the formation of toxic combustion products in significant amounts, such as carbon monoxide.

The heat of combustion of the pyrotechnic aerosol fire suppression compositions are between about 250 calories per gram to about 600 calories per gram. In another embodiment, the heat of combustion of the pyrotechnic aerosol fire suppression compositions are between about 300 calories per gram to about 500 calories per gram. In a particularly preferred embodiment, the heat of combustion of the pyrotechnic aerosol fire suppression compositions are between about 400 calories per gram to about 450 calories per gram. The heat of combustion of the compositions of the present invention is lower than the heat of combustion of other compositions in the art, such as those disclosed in U.S. Pat. Nos. 5,861,106 and 6,019,177 (where the heat of combustion of compositions recited therein are about 860 calories per gram).

These combustion products are applied to flames to suppress and/or extinguish the flames according to the present invention. The halide and carbonate salts suspended in incombustible gas act to physically cool the flame with high specific heat products. In the case of small fires, this element alone will be enough to extinguish the flames. The halide salts, particularly bromide salts, effectively interfere with the chemistry of the flame because of the stability of their atomic radicals. Without being bound by any particular theory, it is thought that on delivery to the fire zone, elevated temperatures cause thermal dissociation of the halide salts, e.g., KBr═K.+Br.. The thermally generated atomic radicals then combine with radical species present in the combustion reaction, thereby quenching or terminating the combustion process.

As discussed, the combustion products of the composition of the invention may include a halide, such as KBr when potassium bromate is used as the principal oxidizer. A smaller portion of additional powdered potassium bromide, chloride or iodide may be added to the composition to increase the flame suppressive properties of the aerosol. Upon reaction, the potassium bromate oxidizer is reduced to potassium bromide, which acts immediately in aerosol form to suppress the flame. Thus, in one embodiment, potassium bromate is the principal oxidizer and about 30 to about 60 percent of the effluent is potassium bromide, the active fire suppressant. In another embodiment, about 40 to about 60 of the combustion products include potassium bromide, preferably about 45 to about 55 percent. In one embodiment, substantially all the halogen is in a solid form after suppressing the flame.

In addition, because halogens may form undesirable compounds, such as HBr, effluent or products of combustion of the composition of the invention may also include a carbonate, such as $K_2CO_3$. For example, potassium bromide may be present in the effluent in an amount from about 40 weight percent to about 60 weight percent of the composition and the potassium carbonate may be present in an amount from about 10 weight percent to about 30 weight percent of the composition. The effluent also includes other gaseous components such as water, carbon dioxide, and nitrogen.

In one embodiment, the combustion products include about 40 weight percent to about 90 weight percent potassium bromide, about 10 weight percent to about 30 weight percent potassium carbonate, about 5 weight percent to about 15 weight percent water, about 10 weight percent to about 30 weight percent carbon dioxide, and about 0.5 weight percent to about 15 weight percent nitrogen, by weight of the total combustion products. In another embodiment, the combustion products include about 40 weight percent to about 55 weight percent potassium bromide, about 18 weight percent to about 25 weight percent potassium carbonate, about 8 weight percent to about 12 weight percent water, about 15 weight percent to about 25 weight percent carbon dioxide, and about 1 weight percent to about 10 weight percent nitrogen. In still another embodiment, the combustion products of the invention include about 45 weight percent to about 50 weight percent potassium bromide, about 18 weight percent to about 22 weight percent potassium carbonate, about 9 weight percent to about 11 weight percent water, about 18 weight percent to about 22 weight percent carbon dioxide, and about 2 weight percent to about 12 weight percent nitrogen.

Substantially all of the halogen in the reaction products is converted into a halogen-containing product that preferably becomes solid as it leaves the vicinity of the flame. This solidification is believed to occur as the reaction products leave the reaction area (e.g., the flame) and cool, thereby vastly decreasing the toxicity and ozone depletion potential of the halogen in the halogen-containing byproduct by ensuring solidification. As used herein, the term "substantially all" is defined to mean at least about 90 weight percent, preferably at least about 95 weight percent, and more preferably at least about 99 weight percent of the flame suppression composition.

The effluents of the composition of the invention preferably have a negligible Ozone Depletion Potential (ODP). For example, when the composition of the invention includes a bromine atom, it is preferably in solid form both before and after use, which reduces the ODP to zero.

In addition, the Global Warming Potential (GWP) of the effluent is preferably about 0.4 or less. In one embodiment, the GWP is about 0.3 or less. In still another embodiment, the GWP is about 0.2 or less. For example, when the composition of the invention is formed from a potassium bromate, the only global warming agent in the effluent is carbon dioxide, which has a GWP of 1. Because the carbon dioxide is present in the effluent in an amount from about 10 percent about 40 percent by weight of the effluent, preferably about 20 percent to about 30 percent, and more preferably about 22 percent to about 26 percent, the GWP of the composition is about 0.2.

The pyrotechnic aerosol fire suppression compositions of the invention may further include a binder. The binder systems encompassed by the present invention are preferred to be chemically stable, so that no reaction between the inorganic halogen component and the binder system will occur prior to use. Thus, the binder chosen for the binder system may include any such resin having a low flame temperature and heat of formation. Preferred binders have good adhesion strength and are flowable under pressure.

Suitable binders include, but are not limited to, silicates, including alkali silicates, cellulose derivatives, cellulose ethers, alginic binders, gums, gels, pectins, starches, polyvinyl compounds or mixtures thereof. Preferable binders include, but are not limited to, hydrolyzed ethyl silicate; sodium silicate; potassium silicate; plasticized polyvinyl alcohol; polyvinyl butyral; polyvinyl acetate; cellulose derivatives, such as hydroxyethylethyl cellulose, hydroxypropyl cellulose, hydroxymethylethyl cellulose, sodium carboxymethyl cellulose, methyl cellulose, hydroxyethyl cellulose; hydroxypropyl cellulose, glycerine, polyvinyl pyrrolidone, ammonium alginate; sodium alginate; potassium alginate; magnesium alginate; triethanolamine alginate; propylene glycol alginate; gum Arabic; gum ghatti; gum tragacanth; Karaya gum; locust bean gum; acacia gum; guar gum; quince see gum; xanthan gum; agar; agarose; caragenneans; fucoidan; furecelleran or mixtures thereof. Other suitable binders include, but are not limited to, carboxy-terminated polybutadiene (CTPB), polyethylene glycol (PEG), polypropylene glycol (PPG), hydroxy-terminated polybutadiene (HTPB), polybutadiene acrylonitrile (PBAN), polybutadiene acrylic acid (PBAA), butacene (HTPB iron adduct), glycidyl azide polymer (GAP), polyglycol adipate (PGA), or compatible mixtures thereof. The determination of the appropriate binder type and other binder system components, and amounts suitable for use therewith, will be readily understood by one of ordinary skill in the art when selected according to the teachings herein.

Particularly preferred binders include hydroxyethyl cellulose, hydroxypropyl cellulose, polyvinyl alcohol, glycerine, and polyvinyl pyrrolidone. Such binder systems increase the strength of pressed solid compositions of the present invention.

The binder, when used, is preferably present in an amount from about 2 weight percent to about 20 weight percent of the composition. In another embodiment, the binder is present in an amount from about 4 weight percent to about 15 weight percent of the composition. In yet another embodiment, the binder is present in an amount from about 8 weight percent to about 12 weight percent of the composition.

Polyols known to one of ordinary skill in the art may be added in addition to the binder to plasticize the binder material and increase the dry strength of the product. Examples of such polyols include, but are not limited glycerol and glycols, such as propylene glycol or polyethylene glycol. Typically, the polyols are present in an amount from about 0.5 weight percent to about 20 weight percent of the composition. In another embodiment, the polyol is present in an amount from about 4 weight percent to about 15 weight percent of the composition. In yet another embodiment, the polyol is present in an amount from about 8 weight percent to about 12 weight percent of the composition. In another embodiment, the polyol is present in an amount from about 2 weight percent to about 6 weight percent.

In another embodiment, the binder system is organic in nature and includes at least a binder or binder resin and a plasticizer, such as those described in U.S. Pat. No. 6,019,177, the entirety of which is incorporated herein by reference. The binder system is preferably in a solid form at a temperature below 100° C.

The binder resin may include at least one of a curable binder, melt cast binder, or solvated binder, or a mixture thereof. The binder system may also include one or more of a curing or bonding agent, an antioxidant, an opacifier, or a halogen scavenger such as lithium carbonate. Non-limiting examples of these additives are detailed below.

Curing agents suitable for use with the invention may include hexamethylene diisocyanate (HMDI), isophorone diisocyanate (IPDI), toluene diisocyanate (TDI), trimethylxylene diisocyanate (TMDI), dimeryl diisocyanate (DDI), diphenylmethane diisocyanate (MDI), naphthalene diisocyanate (NDI), dianisidine diisocyanate (DADI), phenylene diisocyanate (PDI), xylene diisocyanate (MXDI), other diisocyanates, triisocyanates, higher isocyanates than the triisocyanates, polyfunctional isocyanates, or a mixture thereof. The amount of the curing agent needed is generally determined by the desired stoichiometry between the curable binder and the curing agent. The curing agent is typically present in an amount of up to about 5 percent. However, if a curable binder is used, the curing agent is present from about 0.5 percent to about 5 percent.

When a curing agent is used, a cure catalyst is preferably included to accelerate the curing reaction between the curable binder and the curing agent. The cure catalyst, when used, is generally present from about 0.1 percent to about 0.3 percent by weight. Suitable cure catalysts may include alkyl tin dilaurate, metal acetylacetonate, triphenyl bismuth, maleic anhydride, magnesium oxide or a mixture thereof. In one embodiment, the cure catalyst is an equal percent by weight mixture of each of triphenyl bismuth, maleic anhydride and magnesium oxide.

An opacifier may also be used in the binder system, generally in an amount from about 0.01 percent to about 2 percent by weight. An example of a suitable opacifier is carbon black.

In addition, antioxidants may also be used in the invention. Suitable antioxidants may include, but are not limited to, 2,2'-bis(4-methyl-6-tert-butylphenol), 4,4'-bis(4-methyl-6-tert-butylphenol), or a mixture thereof. The antioxidant is typically present in an amount of up about 0.1 percent to about 1 percent by weight.

With or without the various additives, the binder system preferably has a heat of formation of more than about 200 cal/g. Binder systems having high heats of formation are desired to facilitate flame suppression by 1) absorbing more heat from the flame and 2) possessing higher thermal stability to provide for long-term storage. In one embodiment, the heat of formation is negative, preferably less than about −200 cal/g, and more preferably less than about −400 cal/g.

The binder system may include a curative, typically present in an amount of about 3 weight percent or less of the organic binder system, and generally includes a plasticizer, typically present in about 10 weight percent or greater of the organic binder system. In one embodiment, the curative is present in an amount of about 1 weight percent to about 3 weight percent. In another embodiment, the plasticizer is present in an amount of about 30 weight percent or less. The heats of formation for the curative and plasticizer must also be factored into the heat of formation of the binder system when they are included. Any plasticizer with a suitably low heat of formation may be used, such as triacetin or dioctyl adipate (DOA).

The compositions of the present invention may further comprise other additives, such as solid coolants, metal corrosion inhibitors, lubricants, dispersing agents, and other additives. Such additives may be present from about 0.1 weight percent to about 15 weigh percent of the total composition.

Solid coolants may be added to the compositions of the present invention or disposed in the exhaust path to further cool the aerosol stream. Solid coolants include magnesium carbonate and/or basic magnesium carbonate (i.e., a mixture of magnesium carbonate and magnesium hydroxide), ettringite, salts of dicarboxylic acids represented by the formula $HOOC(CH_2)_nCOOH$, wherein n is 0 to 6. Examples of preferred dicarboxylic acids include oxalic acid, succinic acid, or mixtures thereof. Examples of preferred hydroxy alkanedioic acids include tartaric acid (i.e., dihydroxysuccinic acid), dihydroxypentanedioic acid, or mixtures thereof. Accordingly, preferred solid coolants include lithium oxalate, sodium oxalate, potassium oxalate, potassium hydroxyacetate, magnesium oxalate, hydrated magnesium oxalate, lithium succinate, sodium succinate, potassium succinate, magnesium succinate, ettringite, basic magnesium carbonate, magnesium basic tartrate (i.e., a mixture of basic magnesium carbonate and magnesium tartrate) or mixtures thereof.

Metal corrosion inhibitors include, but are not limited to, sebacic acid, sodium or potassium benzoate, sodium or potassium silicate, sodium molybdate, molybdenum oxides, proprietary vapor-phase corrosion inhibitors (such as a complex mixture of amine carboxylates, e.g., VPCI-307 (available at Cortec, Inc.)) or mixtures thereof. Corrosion inhibitors such as silicates, molybdates, sebacates or their free acids may be admixed with the generant composition or placed as a pad, pastille or coating in the path of the generated gaseous products. The active agent may be mixed with a evaporable binder, such as epoxy resin or silicone resin, so that the products of ablation of the pad or coating or pastille are admixed with the flame suppressive aerosol and travel with them to metal or other corrodible surfaces surrounding the area of action. In another incarnation, silicone resin may be mixed with a portion of oxidizer such as potassium nitrate and/or potassium perchlorate, such as to undergo a slow exothermic reaction during function of the device.

Preferred extrusion lubricants include POLYOX® Coagulant Grade polyethylene oxide (available at Union Carbide Chemicals and Plastics Company Inc. of Danbury, Conn.) and preferred dispersing agents include DARVAN® 811 dispersant (available at R.T. Vanderbilt Company, Inc., Norwalk, Conn.).

The pyrotechnic fire suppressant compositions of the present invention have high burn rates. Typically the burn rates of the pyrotechnic fire suppressant compositions at atmospheric pressure and temperature are faster than compositions disclosed in U.S. Pat. Nos. 5,861,106 and 6,019,177 (disclosing compositions having a burn rate of about 80 seconds per inch), and in particular, can be up to at least 4-8 times faster. Typically, the burn rate of the compositions of the present invention at atmospheric pressure is between about, 5 to about 60 seconds per inch, preferably from about 10 to about 40 seconds per inch, more preferably from about 15 to about 20 seconds per inch. Such high burn rates are advantageous because it avoids having to use high pressure force to facilitate high burn rates, particularly when compositions are in a non-solid state while burning. The compositions of the present invention generally remain in the solid state, which allows for high burn rates at low pressures, such as atmospheric pressures.

The compositions of the present invention show unexpected high thermal stability. In a composition containing, for example, potassium bromate, a potassium cyanurate fuel, polyvinyl alcohol and polyethylene glycol, the ignition temperature measured by DSC (differential scanning calorimetry) is in the range of about 323-323° C. This is indicative of excellent thermal stability such that the composition may be exposed to a wide range of ambient temperatures in storage or in use without degradation. Such compositions may also be expected to show excellent active installed life, i.e., in the range of about 5-15 years.

The pyrotechnic aerosol fire suppression compositions of the present invention's rapid burning and ability to produce substantially nontoxic products at low temperatures allows it to have other utilities, such as in smoke grenades, colored signal devices, smoke tracers, agent dispersal compositions, and air current tracer devices of low incendiary potential. The dense, opaque, nontoxic smoke produced, which is transparent to infrared vision devices, provides for utility in crowd control or hostage situations encountered by law enforcement. In addition, the pyrotechnic aerosol fire suppression compositions may also be used as an expulsion charge for items, such as infrared flares and other types of flares. The low reaction temperatures and lack of flash aid in misleading observers and the seeker circuits of infrared-guided missiles. Further, the compositions of the present invention may be used in finely granulated form to generate gas to fill air bags, particularly where low temperatures are required to avoid damage to the air bag itself.

Methods of Preparing Compositions

The pyrotechnic aerosol fire suppressant compositions of the present invention typically are prepared by forming the organic salt fuel component and then mixing the organic salt with at least one oxidizer in an amount sufficient combustion to avoid the production of toxic combustion reaction products during combustion of the composition.

The organic salt fuel component is formed by providing a Group IA or Group IIA base, such as, for example, a carbonate or hydroxide, and contacting the base with an organic acid, forming a Group IA or Group IIA organic salt, as well as water and/or carbon dioxide as by-products. Preferably, the reaction takes place in an aqueous medium, particularly with heat from about 25° C. to about 100° C. and stirring or other mechanical agitation. The aqueous medium comprises water and optionally one or more water-miscible solvents known to one of ordinary skill in the art. The organic acid and Group IA or Group IIA base may be added to the aqueous medium sequentially in any order, or concurrently. Typically, the Group IA or Group IIA base is reacted in a 1:1 mole ratio with the organic acid, although the ratio may vary. For example, the Group IA or Group IIA base may be reacted in excess of the mole equivalent of organic acid, for example, up to two mole equivalents of Group IA or Group IIA base, or the organic acid may be reacted in excess of the mole equivalent of the Group IA or Group IIA base, for example, up to three mole equivalents of organic acid.

Depending on the type of organic acid, the reaction occurs at a desired pH range. Typically, the reaction between the Group IA or Group IIA base and organic acid occurs at a pH of from about 5.5 to about 10. More preferably, the reaction occurs at a pH of about 6.0 to about 9. Most preferably, the reaction occurs at a pH of about 6.5 to about 8. In one example, the addition of a half equivalent of a Group IA or Group IIA base to the organic acid, i.e., a half mole equivalence of Group IA or Group IIA base per mole of organic acid, raises the pH to between about 5.5 and 7.0, at which point the reaction mixture becomes a pH buffer system. Consequently, the generant is highly stable in storage and reduces any possible corrosion of containing metal surfaces.

In one embodiment, the addition of greater than one equivalent of a Group IA or Group IIA base to organic acid can advantageously increase the amount of Group IA or Group IIA carbonates and/or Group IA or Group IIA oxides produced during the use of the pyrotechnic aerosol fire suppressant compositions. Typically, the first equivalent of the Group IA or Group IIA base reacts with the organic acid at a low temperature, generally between about 10° C. to about 50° C., depending on the base and organic acid selected. For example, the reaction of a first equivalent of potassium carbonate with cyanuric acid takes place at about 15° C. to about 40° C. Any Group IA or Group IIA base in excess of the first equivalent reacts with the organic acid endothermically at about 70° C. to about 120° C. Following the above example, the reaction of a second equivalent of potassium carbonate with cyanuric acid takes place at about 85° C. to about 94° C. Once the organic salt fuel component is formed, it is optionally isolated, purified and/or further pulverized by methods known to one of ordinary skill in the art prior to reacting it with the oxidizer. The organic salt typically contains between about 0.15 to about 3 moles of Group IA or Group IIA atoms per mole of acidic sites of the organic acid. Preferably, the organic salt contains between about 0.20 to about 2.5 moles of Group IA or Group IIA atoms per mole of acidic sites of the organic acid. More preferably, the organic salt contains between about 0.1 to about 1.0 moles of Group IA or Group IIA atoms per mole of acidic sites of the organic acid. In another preferably embodiment, the organic salt contains between about 0.40 to about 0.70 moles of Group IA or Group IIA atoms per mole of acidic sites of the organic acid. As mentioned above, all upper and lower limits of the ranges disclosed herein may be interchanged to form new ranges.

The organic salt fuel component is reacted or contacted with an oxidizer in sufficient amounts such that the resulting pyrotechnic aerosol fire suppressant composition produces nontoxic reaction products when burned. As discussed above, the weight ratio of oxidizer to organic salt preferably is from greater than about 1:1, allowing for a cleaner burning composition. In one embodiment, the weight ratio of oxidizer to organic salt is from about 11:9 to about 4:1. In another embodiment, the weight ratio of oxidizer to organic salt is from about 3:2 to about 3:1. In a preferred embodiment, the weight ratio of oxidizer to organic salt is about 3:2 ratio. These amounts form rapidly burning pyrotechnic aerosol fire suppressant compositions while avoiding toxic combustion products. Further, such compositions burn at relatively low temperatures and are stable to accidental ignition by mechanical impact or friction. The produced aerosol does not quickly pillar upward in comparison to prior art pyrotechnic aerosol generants.

The organic salt fuel component and the oxidizer may be combined by mechanical mixing, with or without the use of additional fluid phase, filtered, dried and formed into solid units, such as pellets, discs, granules, having a density of between about 1.0 to about 3.0 grams per cubic centimeter. Preferably, the density of the solid units are between about 1.5 to about 2.8 grams per cubic centimeter, more preferably from about 2.0 to about 2.5 grams per cubic centimeter. Any binders or other additives typically are added during the combination and mixing of the organic salt fuel component and the oxidizer to form the final pyrotechnic aerosol fire suppressant composition.

In one embodiment, the organic salt fuel component and oxidizer mixture may be compounded to produce some minor volume of oxygen in the exhaust products. Oxygen-containing compositions produce lower temperature gas and an increased concentration of suppressive aerosol. Preferably, the gaseous oxygen content is at or below 12% by volume. Oxygen contents of 12% by volume or below do not negatively affect the flame suppressive action of the aerosol. In a more preferred embodiment, the oxygen content in the solid unit is at or below 7% by volume. In these cases, the proportion of metal halogen oxidizer may be increased.

In one embodiment, the mixture of organic salt fuel component and the oxidizer is granulated and dried using methods known to one of ordinary skill in the art. The dried granules are pressed to form a dense, strong and compact aerosol-generating mass. To increase the rate of burning, the granules may be used directly or the mass is extruded to form small-diameter cylinders or holed or porous cylinders having increased surface area.

In another embodiment, the pyrotechnic aerosol fire suppressant composition can be continuously made in a screw-driven extruder, such as a twin-screw extruder. A lubricant and dispersing agent are added to incoming streams of powdered organic acid, Group IA or Group IIA base solution, binder and oxidizer in the twin-screw extruder. For example, the lubricant and dispersant can be added as a single solution containing 0.1% of POLYOX® Coagulant Grade polyethylene oxide and 0.25% DARVAN® 811 dispersant. The mixture of organic acid, Group IA or Group IIA base, binder and oxidizer can be extruded at between about 10% to about 25% water content, preferably about 12% to about 20% water content, and formed into the desirable solid unit, such as cylinders or other suitable shapes for eventual pyrotechnic aerosol use.

The pyrotechnic aerosol fire suppressant compositions of the present invention may be used as pressed or extruded pellets, cylinders, or slabs in a generator housing. The grains of the pyrotechnic aerosol fire suppressant composition may have a thick cross section, i.e. large gross sections, and still provide a relatively high burn rates/short burning times. Thus in one embodiment, the cross section of the grains have an area of between about 0.1 $cm^2$ to about 1 $cm^2$, while maintaining a burn rate of at least 0.02 seconds per inch at atmospheric pressure.

Devices

The compositions described above may be dispersed as an aerosol through the use of various devices. Non-limiting examples of dispersal devices are provided in the following embodiments.

In one embodiment, the compositions are placed in a vessel or casing, typically a rigid chamber, having at least one opening to disperse the composition as combustion products in an aerosol. Preferably, the vessel or casing is a cylinder, although a vessel of any shape may be used, including elongated vessels having various cross sectional shapes, such as triangle, square, rectangle, oval and the like. The vessel or casing preferably is comprised of metal, composite or other inorganic construction, such as a ceramic, such that the temperature of combustion of the compositions of the present invention does not damage or destroy it. The vessel or casing is preferably capable of withstanding internal pressurization of at least about 50 psi. The vessel or casing may have an elongated shape to allow it to be mounted along a wall or the intersection of a wall and ceiling. A solid coolant can be disposed within the vessel or casing in the exhaust path to further cool the aerosol stream created by combusting the pyrotechnic aerosol composition.

Preferably, the pyrotechnic aerosol fire suppressant compositions are pressed into a shaped solid unit, such as cylinders, slabs, blocks, cones, and the like, and arranged on a flat surface, such as a plate having various shapes (e.g., circular plate, square plate, rectangular plate, triangular plate, oval plate, and the like). The flat surface may be composed of any material that is inert and capable of withstanding the combustion of the pyrotechnic aerosol fire suppressant compositions, such as, for example, a laminated phenolic fabric. In a preferred embodiment, the outer rim of the flat surface is raised to form a lip, where a second similarly shaped flat surface having a raised outer rim is attached above the shaped solid units and the second flat surface is arranged to form an annular vent around the circumference of the vessel comprised of the two flat surfaces.

Typically, an ignition assembly is attached to the outer lip of the vessel and initiates the burning of the pyrotechnic aerosol fire suppressant composition, emitting a thick flame-suppressive aerosol that contains nontoxic combustion products, as described herein. The aerosol that is generated unexpectedly does not rise rapidly, as compared to generant plumes of the compositions described in the art, including U.S. Pat. Nos. 5,861,106 and 6,019,177. Ignition is facilitated by an electric signal, pull-fuse actuator, percussion primer, or pyrotechnic thermal sensors.

Preferably, each shaped unit has a diameter ranging from 0.1 inches to about 3 inches and each shaped unit has a weight of about 1 gram to about 350 grams. In one embodiment, the shaped solid units are arranged symmetrically on the flat surface and preferably is attached to the plate by an adhesive, such as silicone RTV rubber, epoxy or a composite structure of inorganic coolant materials, such as cast ettringite plus a minor proportion of adhesive.

In one embodiment, a screen or mesh is disposed between the pyrotechnic aerosol fire suppressant compositions and the annular vent and acts as a support for solid coolants that may be used to attain a lower temperature in the exhaust stream. The escape space for the aerosol is preferably sealed with an impermeable foil, film, or pressure sensitive tape, such as aluminum, to stop ingress of exterior moisture and other elements prior to use. Upon ignition, the pressure inside the vessel increases and ruptures the impermeable foil, film or pressure sensitive tape, which thereby releases the flame suppressant aerosol.

EXAMPLES

Embodiments of the present invention may be more fully understood by reference to the following example. While this example is meant to be illustrative of propellant compositions made according to the present invention, the present invention is not meant to be limited by the following example.

Example 1

Preparation of Pyrotechnic Aerosol Fire Suppressant Composition

About 165 grams of commercial grade cyanuric acid dihydrate is placed in a glass flask and 92 grams of anhydrous potassium carbonate powder is added. About 75 mL of distilled water then is added to the mixture, forming a thick slurry. The reaction between the cyanuric acid and potassium carbonate generates carbon dioxide gas, which continues to generate carbon dioxide during heating the reaction mixture to about 100° C., and forms potassium cyanurate. During this process granules of cyanuric acid are seen to shrink and finally disappear. After the reaction mixture is cooled to room temperature and the excess liquid is decanted, about 260 grams of ground potassium bromate is added and the reaction mixture is mixed further. A sufficient amount of polyvinyl alcohol solution (CELVOL 21205 or equivalent, available at Celanese, Calvert City, Ky.) to provide about 1.5% polyvinyl alcohol binder in the final product. An additional 1.5% glycerol is added to plasticize the polyvinyl alcohol binder and increase the dry strength of the final product. The reaction mixture is granulated and dried, yielding a composition comprising potassium cyanurate and potassium bromate for use as a pyrotechnic aerosol fire suppressant composition. The amount of potassium added as carbonate is sufficient to form a fuel having an elemental analysis at about K:C:H:N:O makeup of 0.5 parts K, 3 parts C, 2.5 parts H, 3 parts N and 3 parts O, i.e., for every equivalent of K there are 2 cyanurates.

Example 2

Preparation of Device Containing Pyrotechnic Aerosol Composition

The potassium cyanurate/potassium bromate mixture obtained in Example 1 was pressed into cylinders having a diameter of about 1.1 inches and a weight of about 50 grams each. The pressing force was approximately 50,000 pounds. Forty-seven cylinders were arranged symmetrically on a laminated phenolic-fabric circular plate 7 mm thick and 280 mm wide. The aerosol generant cylinders were attached to the bottom of the circular plate with an adhesive. The outer rim of the plate was raised 13 mm to form a 25 mm wide lip. Another similar plate was attached above the cylinders by three bolts and the plates were arranged to form a 13 mm wide annular vent around the circumference of the disc-shaped container. An ignition assembly of two pull-wire igniters and two 50 mm lengths of safety fuse were attached to the outer lip of the container. The inner fuse ends and the center cylinder were primed with pyrotechnic slurry. The annular gas escape area was sealed with aluminum pressure sensitive tape (available at 3M, Minneapolis, Minn.). The device was chilled to −45 F to simulate cold climate use. The pull-wire igniters were activated with a lanyard. Once activated, the device burned for less than 30 seconds, emitting a thick flame-suppressive aerosol having no visible flame. The phenolic-fabric discs were darkened in color, but was not consumed by the burning of the flame suppressant composition. The smoke plume did not rise rapidly.

It is to be understood that the invention is not to be limited to the exact configuration as illustrated and described herein. The embodiments discussed in the Detailed Description of the Invention are not intended to limit the invention. Accordingly, all expedient modifications readily attainable by one of ordinary skill in the art from the disclosure set forth herein, or by routine experimentation therefrom, are deemed to be within the spirit and scope of the invention as defined by the appended claims.

What is claimed is:

1. A pyrotechnic aerosol fire suppression composition comprising:

an oxidizer represented by the formula $M(XO_x)_y$, wherein M is selected from a Group IA atom, a Group IIA atom, and a Group IIIA atom, X is selected from the group consisting of Cl, Br and I, x is 1-4, and y is 1-3; and a fuel component comprising melamine cyanurate, a Group IA or Group IIA salt of an organic acid, or a mixture thereof, wherein the organic acid is selected from the group consisting of cyanuric acid, isocyanuric acid, hydroxyacetic acid, and mixtures thereof;

wherein the oxidizer is present in a greater amount by weight percent than the fuel component, and wherein the composition has a heat of combustion of between about 250 calories per gram and 600 calories per gram, and wherein the combustion products consist essentially of about 5 percent to about 15 percent $H_2O$, about 10 percent to about 30 percent $CO_2$, about 0.5 percent to about 15 percent nitrogen, about 40 percent to about 90 percent potassium bromide, and about 10 percent to about 30 percent potassium carbonate by total weight of the combustion products.

2. The composition of claim 1, wherein M is selected from the group consisting of lithium, potassium, sodium, strontium, magnesium, and aluminum.

3. The composition of claim 1, wherein $XO_x$ is selected from the group consisting of a chlorate, a bromate, an iodate, a perchlorate, and a chlorite.

4. The composition of claim 3, wherein $XO_x$ is a bromate.

5. The composition of claim 1, wherein $M(XO_x)_y$ is selected from the group consisting of sodium bromate, potassium bromate, and mixtures thereof.

6. The composition of claim 1, wherein the fuel component is melamine cyanurate; a Group IA or Group IIA salt of cyanuric acid, isocyanuric acid, hydroxyacetic acid, or a mixture thereof.

7. The composition of claim 6, wherein the fuel component is selected from the group consisting of melamine cyanurate, potassium cyanurate, potassium isocyanurate, potassium hydroxyacetate, magnesium cyanurate, magnesium isocyanurate, magnesium hydroxyacetate, and mixtures thereof.

8. The composition of claim 1, wherein the weight ratio of oxidizer to fuel component is from about 3:2 to about 4:1.

9. The composition of claim 1, further comprising a binder selected from the group consisting of a silicate, a cellulose derivative, a cellulose ether, an alginic binder, a gum, a gel, a pectin, a starch, a polyvinyl compound, and a mixture thereof, and optionally a polyol selected from the group consisting of a glycerol and a glycol.

10. The composition of claim 1, wherein the heat of combustion of the pyrotechnic aerosol fire suppression composition is between about 300 calories per gram to about 500 calories per gram.

11. A pyrotechnic aerosol fire suppression composition comprising:

an oxidizer represented by the formula $M(XO_x)_y$, wherein M is selected from a Group IA atom, a Group IIA atom, and a Group IIIA atom, X is selected from the group consisting of Cl, Br and I, x is 1-4, and y is 1-3; and a fuel component comprising melamine cyanurate, a Group IA or Group IIA salt of an organic acid, or a mixture thereof, and wherein the oxidizer is present in a greater amount by weight percent than the fuel component, wherein the composition has a heat of combustion of between about 300 calories per gram and 500 calories per gram, and wherein the combustion products are selected from the group consisting of $H_2O$, $CO_2$, nitrogen, a halide salt, a carbonate salt, and mixtures thereof, and wherein the combustion products consist essentially of about 5 percent to about 15 percent $H_2O$, about 10 percent to about 30 percent $CO_2$, about 0.5 percent to about 15 percent nitrogen, about 40 percent to about 90 percent potassium bromide, and about 10 percent to about 30 percent potassium carbonate by total weight of the combustion products.

12. The composition of claim 11, wherein the heat of combustion is about 400 calories per gram to about 450 calories per gram.

* * * * *